US008807798B1

(12) United States Patent
Loomis

(10) Patent No.: US 8,807,798 B1
(45) **Date of Patent: *Aug. 19, 2014**

(54) DECORATIVE HOLOGRAPHIC ORNAMENT

(71) Applicant: Loominocity, Inc., Napa, CA (US)

(72) Inventor: Jason Loomis, Decatur, GA (US)

(73) Assignee: Loominocity, Inc., Napa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/767,833

(22) Filed: Feb. 14, 2013

Related U.S. Application Data

(63) Continuation of application No. 12/986,066, filed on Jan. 6, 2011, now Pat. No. 8,398,269.

(60) Provisional application No. 61/292,737, filed on Jan. 6, 2010.

(51) Int. Cl.
*F21S 4/00* (2006.01)
*F21V 3/04* (2006.01)
*F21L 4/02* (2006.01)

(52) U.S. Cl.
CPC ..... *F21V 3/0472* (2013.01); *F21L 4/02* (2013.01); *Y10S 362/806* (2013.01)
USPC ..... 362/249.16; 362/186; 362/249.14; 362/806

(58) Field of Classification Search
USPC ..... 362/249.14, 249.15, 249.16, 186, 806
See application file for complete search history.

(56) References Cited

U.S. PATENT DOCUMENTS

| | | | |
|---|---|---|---|
| 4,417,299 | A | 11/1983 | Rupp |
| 5,034,547 | A | 7/1991 | Smith et al. |
| 5,237,491 | A | 8/1993 | McCarter |
| 6,341,874 | B1 | 1/2002 | Rubin |
| 7,118,249 | B2 | 10/2006 | Hsu et al. |
| 7,520,633 | B2 | 4/2009 | Hornsby et al. |
| 7,854,532 | B2 | 12/2010 | Myers et al. |
| 8,002,456 | B2 | 8/2011 | Chien |
| 8,128,259 | B2 | 3/2012 | Myers et al. |
| 2004/0233668 | A1 | 11/2004 | Telfer et al. |
| 2006/0262529 | A1 | 11/2006 | Hornsby et al. |
| 2006/0291217 | A1 | 12/2006 | Vanderschuit |

*Primary Examiner* — John A Ward

(74) *Attorney, Agent, or Firm* — Craige Thompson; Thompson Patent Law Offices

(57) ABSTRACT

In an illustrative embodiment, a decorative holographic ornament has a body of generally clear or translucent hard plastic or similar material, of a size suitable for use as a tree ornament or the like. Molded holographic film is applied to the inside surface of the ornament, so that it is protected by the plastic body. An inner wire spool or core is supported in the center of the ornament, and LED wire is wrapped through or around the core. When the LED lights on the LED wire are illuminated, holographic images of the LEDs are generated and visible from the outside of the ornament with a pleasing "three-dimensional" aesthetic effect.

11 Claims, 2 Drawing Sheets

DECORATIVE HOLOGRAPHIC ORNAMENT

CROSS-REFERENCE TO RELATED APPLICATIONS

The present application claims the benefit of the filing date of U.S. Provisional Patent Application Ser. No. 61/292,737, filed Jan. 6, 2010, and of U.S. patent application Ser. No. 12/986,066, filed Jan. 6, 2011, each of which is incorporated by reference in its entirety as if fully set forth herein

TECHNICAL FIELD

Various embodiments relate generally to lights and decorations, and more particularly to an improved decoration in the form of a decorative holographic ornament.

SUMMARY

An illustrative embodiment provides an improved decoration in the form of a decorative holographic ornament. The ornament is preferably constructed with a body of generally clear or translucent hard plastic or similar material, of a size suitable for use as a tree ornament or the like. Molded holographic film is preferably adhered or otherwise applied to the inside surface of the ornament, so that it is protected by the plastic body. An inner wire spool or core is supported in the center of the ornament (as by being sandwiched in place by two halves of the ornament), and LED wire (thin wire with LED lights embedded and then covered with epoxy that acts as an insulator and lens) is wrapped through or around the core. When the LED lights on the LED wire are illuminated, holographic images of the LEDs are generated and visible from the outside of the ornament with a pleasing "three-dimensional" aesthetic effect.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF ILLUSTRATIVE EMBODIMENTS

An illustrative embodiment provides an improved decoration in the form of a decorative holographic ornament. The ornament is preferably constructed with a body of generally clear or translucent hard plastic or similar material, of a size suitable for use as a tree ornament or the like. Molded holographic film is preferably adhered or otherwise applied to the inside surface of the ornament, so that it is protected by the plastic body. An inner wire spool or core is supported in the center of the ornament (as by being sandwiched in place by two halves of the ornament), and LED wire (thin wire with LED lights embedded and then covered with epoxy that acts as an insulator and lens) is wrapped through or around the core. When the LED lights on the LED wire are illuminated, holographic images of the LEDs are generated and visible from the outside of the ornament with a pleasing "three-dimensional" aesthetic effect.

Power may be supplied to the LED wire by an external battery pack. Alternatively, an internal battery pack may be incorporated into the core, with the LED wire wrapped around the outside of the core, and a DC connector may be incorporated into the outer shell of the ornament to enable recharging of the internal battery pack. A further alternative provides a plug-in power source, such as a C-7 or C-9 screw base so that the inventive ornament can be installed on an existing light string.

A timer and/or controller, which may be incorporated into the battery pack, enables selection of a desired on/off cycle for the LED lights (e.g., 6 hours on, 18 hours off), and various functions such as random phasing, steady on, and/or random twinkle of the LED lights. Two or more LED wire circuits may be employed and alternately illuminated for a pleasing effect.

In an illustrative embodiment, the ornament body of the inventive structure could be formed as different shapes, such as a sphere, tree (cone), cube, or other shape. The holographic film can be selected to generate any desired pattern or image, such as snowflakes, stars, or letters.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

Figure 1:
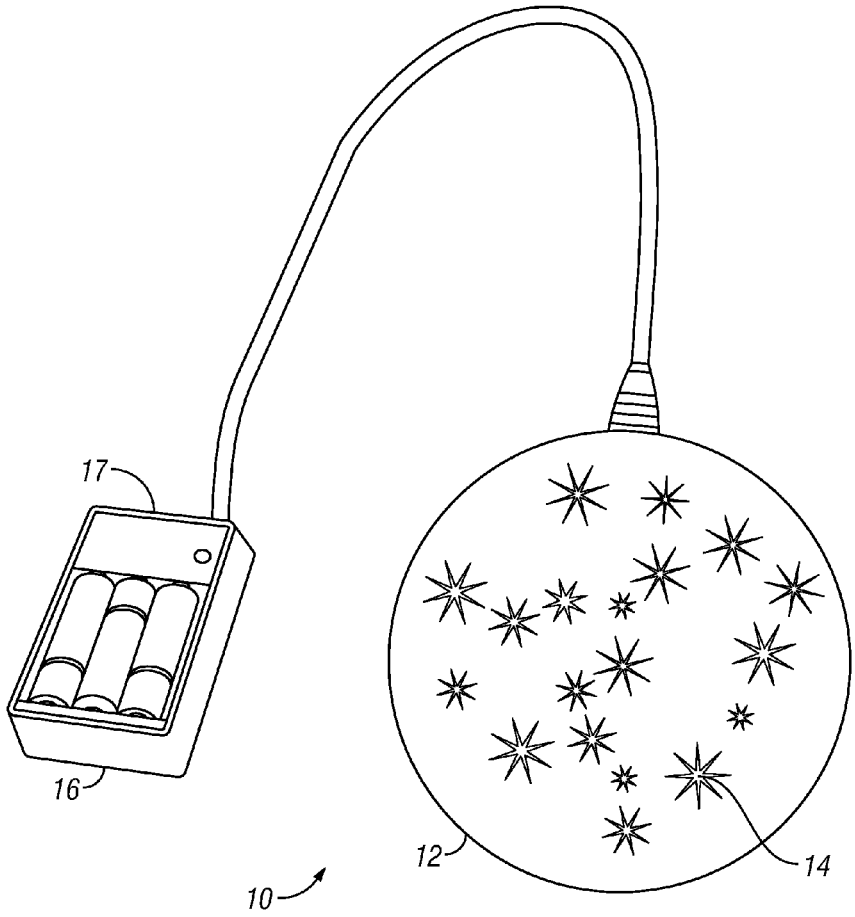
FIG. 1 is a front elevation view of an exemplary decorative holographic ornament and associated external battery pack.
Figure 2:
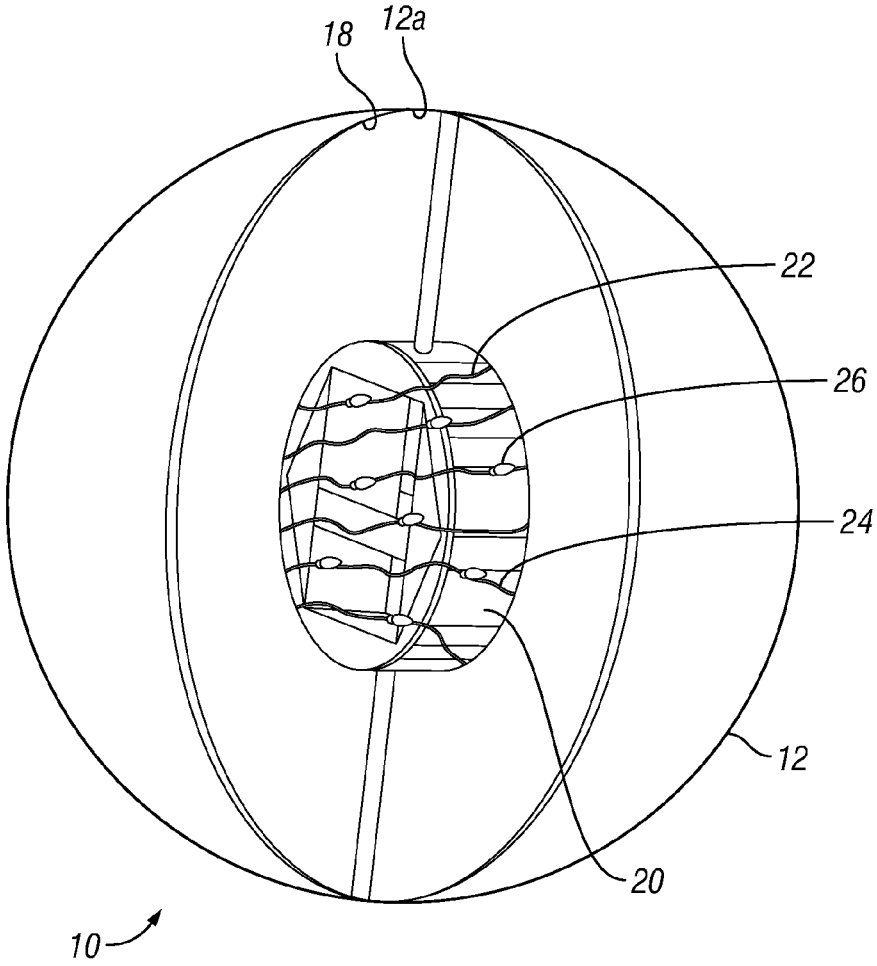
FIG. 2 is a partially cutaway view of an exemplary decorative holographic ornament illustrating the holographic film applied to the inside surface of the ornament, inner core supported in the center of the ornament, and LED wire wrapped around the core.

Referring to FIGS. 1 and 2, wherein like reference numerals refer to like components in the various views, there is illustrated therein a new and improved decorative holographic ornament, generally denominated 10 herein.

FIG. 1 is a front elevation view of the decorative holographic ornament 10. The ornament 10 is preferably constructed as a hollow sphere 12 or other shape of generally clear or translucent hard plastic or similar material, of a size suitable for use as a tree ornament or the like. When the LED lights on the LED wire inside the hollow sphere 12 are illuminated, holographic images 14 of the LEDs are generated and visible from the outside of the ornament with a pleasing aesthetic effect. Power may be supplied to the LED wire by an external battery pack 16, which may include a timer and/or controller 17 for the LEDs.

FIG. 2 is a partially cutaway view of the decorative holographic ornament 10 illustrating the holographic film 18 applied to the inside surface 12*a* of the ornament, such that the hard plastic sphere 12 protects the holographic film from damage. An inner core, such as a flat perforated plastic disc 20, is supported in the center of the ornament, and a pair of LED wire circuits 22, 24 each with a plurality of LED lights 26 are wrapped through or around the core or through the perforations in the core. In the preferred embodiment, the LEDs 26 on the LED wires 22, 24 (e.g., for a total of thirty-six LED lights +/−) are randomly spaced around the core, typically one to two inches from the holographic film 18 for best holographic effect. The two LED wire circuits 22, 24 may be alternately phased on and off for a pleasing effect.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed is:

1. A decorative ornament comprising:

a substantially transparent hollow body portion having an inside surface;

holographic film applied to said inside surface;

an inner core supported proximate the center of said body portion; and,

LED lights attached to said inner core, wherein when said LED lights are illuminated, holographic images are generated and visible from the outside of said decorative ornament.

2. The decorative ornament of claim 1 wherein said LED lights comprise LED wire.

3. The decorative ornament of claim 1 further comprising a battery pack.

4. The decorative ornament of claim 1 wherein said inner core comprises a flat perforated plastic disc.

5. The decorative ornament of claim 1 wherein said LED lights comprises a plurality of LED wire circuits.

6. The decorative ornament of claim 1 further including a controller enabling selection of a desired on/off cycle for said LED lights.

7. The decorative ornament of claim 1 wherein said hollow body portion comprises a sphere.

8. A decorative ornament comprising:

a translucent plastic housing having an inside surface defining a hollow interior of said housing;

an inner core disposed within said hollow interior of said housing;

a plurality of LED lights supported by said inner core and disposed within said hollow interior of said housing, said LED lights being spaced around said core; and, holographic image-producing features applied to said inside surface of said translucent plastic housing, wherein when said LED lights illuminate, images with a holographic effect are generated and visible from outside of said housing.

9. The decorative ornament of claim 8 wherein said translucent plastic housing comprises a hard plastic.

10. The decorative ornament of claim 8, wherein said translucent plastic housing is substantially transparent.

11. The decorative ornament of claim 8, wherein said holographic image-producing feature applied to said inside surface further comprises a molded film.

* * * * *